US011607712B2

(12) United States Patent
Arnason et al.

(10) Patent No.: US 11,607,712 B2
(45) Date of Patent: Mar. 21, 2023

(54) FEEDBACK CORRECTION FOR GRADING SYSTEMS

(71) Applicants: Skaginn HF., Akranes (IS); Style EHF., Gardabaer (IS)

(72) Inventors: Ingolfur Arnason, Akranes (IS); Egill Thor Ragnarsson, Kopavogur (IS)

(73) Assignee: LAMBHUSASUND EHF., Akranes (IS)

( * ) Notice: Subject to any disclaimer, the term of this patent is extended or adjusted under 35 U.S.C. 154(b) by 285 days.

(21) Appl. No.: 16/606,875

(22) PCT Filed: Apr. 23, 2018

(86) PCT No.: PCT/IS2018/050004
§ 371 (c)(1),
(2) Date: Oct. 21, 2019

(87) PCT Pub. No.: WO2018/193484
PCT Pub. Date: Oct. 25, 2018

(65) Prior Publication Data

US 2021/0101182 A1 Apr. 8, 2021

(30) Foreign Application Priority Data

Apr. 21, 2017 (IS) ..... 050177

(51) Int. Cl.
*B07C 5/36* (2006.01)
*B07B 13/065* (2006.01)
*B07C 5/342* (2006.01)

(52) U.S. Cl.
CPC ..... *B07C 5/362* (2013.01); *B07B 13/065* (2013.01); *B07C 5/342* (2013.01)

(58) Field of Classification Search
CPC B07C 5/362; B07C 3/342; B07C 5/36; B07B 13/065; B07V 5/36
See application file for complete search history.

(56) References Cited

U.S. PATENT DOCUMENTS 1,466,764 A * 9/1923 Dodd ..... B07B 13/065 209/620
2,686,591 A * 8/1954 Harden ..... B07B 13/065 209/632

(Continued)

FOREIGN PATENT DOCUMENTS

EP 0312292 A1 * 4/1989
EP 0312292 A1 4/1989

(Continued)

OTHER PUBLICATIONS

International Search Report and Written Opinion dated Aug. 10, 2018 for corresponding International Application No. PCT/IS2018/050004.

*Primary Examiner* — Patrick H Mackey
(74) *Attorney, Agent, or Firm* — Tarolli, Sundheim, Covell & Tummino LLP

(57) ABSTRACT

An apparatus and a method for grading sensitive products. The apparatus and a method treat the objects to be graded gently and is accurate and may be constructed so as to handle extremely large quantities. The grading device (1) has grading channels that are wider at the outlet than at the intake. A belt machine draws the objects forward between two inclined belts (6) which form the channel. The device and the method make possible to make corrections in the grading process and to fine-tune the grading unit during the grading process.

17 Claims, 10 Drawing Sheets

(56) References Cited

U.S. PATENT DOCUMENTS 5,732,147 A * 3/1998 Tao ..... B07C 5/3422
382/110
6,065,607 A * 5/2000 Magnusson ..... B07B 13/065
209/665

FOREIGN PATENT DOCUMENTS

| | | | | | |
|---|---|---|---|---|---|
| GB | 1506672 | A | | 4/1978 | |
| WO | 9640452 | A1 | | 12/1996 | |
| WO | 9641541 | A1 | | 12/1996 | |
| WO | WO-03045591 | A1 | * | 6/2003 | ..... A01K 61/90 |
| WO | 2006120706 | A1 | | 11/2006 | |
| WO | WO-2006120706 | A1 | * | 11/2006 | ..... B07B 1/4636 |

* cited by examiner

FEEDBACK CORRECTION FOR GRADING SYSTEMS

RELATED APPLICATIONS

The present application is a U.S. National Stage application under 35 USC 371 of PCT Application Serial No. PCT/IS2018/050004, filed on 23 Apr. 2018; which claims priority from IS Patent Application No. 050177, filed 21 Apr. 2017, the entirety of both of which are incorporated herein by reference.

FIELD OF INVENTION

The present invention relates grading systems for grading objects. The device and the method make possible to make corrections in the grading process and to fine-tune the grading unit during the grading process.

BACKGROUND

The process of grading objects such as small and delicate marine species or fruit can be a problem due to their small size and the volume to be processed at each time and the fact that the quality of the food items deteriorates quickly upon rough handling procedures. An efficient grading process is therefore required based on selection criteria such as size and/or the sex.

Several different types of grading devices are known for grading fish and food items, which grade the items according to an assessment of their thickness. The known devices are based on belts and rollers as well as shaker-graders, which use several grading channels.

WO9641541 discloses a grading device based on specially-designed conveyor equipment so-called ridge-belts, which move the objects forwards without shaking or rubbing the items during the grading process. Such grading devices are designed so that the grading channels are narrower at the in-feed end (receiving end) than at the outlet end. This device allows for more gentle treatment of the objects to be graded, with a high processing rate. The problem solved by using this grading device is that the material is arranged into a single layer in optimal position onto the grading apparatus. This ensures that small items are not carried on top of larger items into a wrong grading compartment.

The distance between the ridge belts is set with adjustment devices arranged perpendicular under the belts and partially supporting the belts. Such adjustment devices contain alternatively arranged support members and adjusting members where both components comprise screwing sections which regulate an increase or a decrease in the gap between the support members when an adjusting screwing shaft penetrating the adjusting members is rotated.

One of the problems relating to grading objects in large quantities in several categories at high speed is being able to adjust the gap between the ridge belts during operation and to determine the size and species distribution in the objects being graded.

SUMMARY OF THE INVENTION

The present invention relates to grading devices, which treat the objects to be graded gently, is accurate and may be constructed so as to handle extremely large quantities. The grading device of the present invention comprises conveying mechanisms and imaging means to characterize graded objects and redirect wrongly graded objects to correct grading receptacles. The grading device is based on a conventional grading conveyor with continuously running ridge-belts and accurate adjusting means to grade the objects and high speed imaging and image/data processing means to determine size, weight or species or any combination thereof to ensure correct grading and providing a correction of grading with further conveying and sorting mechanisms and feedback correction to the control means or computing means for the grading device. The grading apparatus of the present invention is suitable for grading sensitive objects such as marine species or fruits and vegetables. A grading conveyor having a plurality of endless ridge-belts arranged side by side with a gap between the belts increasing in the direction of movement, conveys the objects and releases them onto the take away conveyors underneath the grading conveyor. Adjusting devices placed underneath the ridge belts adjust the distance between the ridge-belts along the length of the ridge-belts accurately and this adjustment can be changed during grading in light of the weight/size or species distribution of the objects to be graded. An image device obtains images of each object as they are conveyed away from the grading means on take away conveyors and an industrial computer determines at least one characteristic property of each object to use for correcting the grading process or to re-calibrate or fine-tune the grading unit. A sorting unit with diverting plate(s) directs the graded items either directly to a collection receptacle or a second take away conveyor specific for this grading category or onto distribution conveyors which take wrongly graded objects to other collection receptacles or other second take away conveyors specific for other grading categories. One of the limiting factors for grading with vision is the speed of imaging and image processing if a high percentage of the objects is of same species in a few weight categories. This will also affect the quality of the grading process as too many objects will need fall through in a short area of the ridge belts. The settings of apparatus of the present invention can be changed during the grading process making it possible to collect the same category on a number of take away conveyors by altering the gap over an increased number of take away conveyors.

The new and improved method and device for grading objects with a high capacity grading apparatus, which can identify erroneously graded objects and correct the mistakes using imaging means, a sorting unit and distribution/correction conveyors with the aid of an industrial computer and software for operating the apparatus of the present invention. In some embodiments of the present invention, the following features may be employed: a) a collecting unit for each of the first take away conveyors placed underneath the grading apparatus, b) an imaging device positioned above each of the take away conveyors underneath the grading apparatus, c) connecting the computing device of the invention to each of the imaging devices for processing the images taken of the objects passing under the imaging devices to determine at least one characteristic property of each object, d) providing feedback signals from the computing means based on image data to optimize the grading process by altering the distance between the belts on the grading conveyor, and e) placing the sorting unit below the out feed end of each of the take away conveyors, but above the distribution/correction conveyors, It is an object of the present invention to overcome and/or ameliorate the aforementioned drawbacks of the prior art and to provide an improved and/or alternative and/or additional method or device for facilitating grading of sensitive objects. It is one preferred object of the present invention to provide a method and device to facilitate grading of objects such as fish or other marine species, fruit or vegetables using vision technology to correct wrongly graded or sorted objects. Moreover, it is a preferred object of the present invention to provide a method and device, preferably designed to grade a large volume of fish with correction options based on image analysis and conveyor solutions. Another preferred object of the present invention is to provide a device having a design with a grading unit comprising plurality of endless ridge-belts arranged side by side, where adjustment devices can accurately and during grading set the distance between the ridge belts without stopping the continuous running of the endless ridge-belts.

The object(s) underlying the present invention is (are) particularly solved by the features defined in the independent claims. The dependent claims relate to preferred embodiments of the present invention. Further additional and/or alternative aspects are discussed below.

Thus, at least one of the preferred objects of the present invention is solved by an apparatus for grading objects. The apparatus comprises a grading unit, two or more first take away conveyors, a sorting unit for each of the first take away conveyors, one or more distribution/correction conveyors, collecting means for each of the first take away conveyors, and computing means. The grading unit further comprises i) a plurality of endless ridge-belts arranged side by side and moved continuously in a forward direction, forming a gap there in-between, the gap being increased in the direction of movement, and ii) two or more adjusting devices arranged underneath said ridge-belts, said adjusting devices arranged for adjusting the distance between said ridge-belts along the length of the ridge-belts. The two or more first take away conveyors each comprise i) one or more parallel conveyor belts arranged perpendicular under the plurality of endless ridge-belts, and imaging means positioned above each first take away conveyor. Each collection means is positioned below it's corresponding first take away conveyor. The computing means is connected to each of the imaging means for processing said one or more images to determine at least one characteristic property of each object graded by the grading unit. The sorting unit is positioned below the out feed end of each of the first take away conveyors, but above the distribution conveyors. The sorting unit comprises diverting means for diverting objects dropped off the out feed end of the first take away conveyor onto one of the distribution conveyors or into the collecting means. Another preferred object of the present invention is solved by a method grading objects comprising a) grading objects in a grading unit comprising a plurality of endless ridge-belts arranged side by side and moved continuously in a forward direction and forming a gap there in-between. The gap increases in the direction of movement, where two adjacent belts receive, convey and release the products as the gap there between becomes greater than the product thickness onto the take away conveyors, b) adjusting the distance between said ridge-belts along the length of the ridge-belts using an adjusting device arranged underneath said ridge-belts, c) receiving objects from the grading unit on first take away conveyors arranged perpendicular under the plurality of endless ridge-belts, d) obtaining one or more images of all objects conveyed on each take away conveyor using imaging means, and e) using the computing means for processing said one or more image to determine at least one characteristic property of each object. The method further comprises the steps of: f) using the sorting unit positioned below the out feed end of each first take away conveyor, but above the distribution conveyors, for diverting objects dropped off the out feed end of said first take away conveyor into either i) the collection means positioned below the out feed end of said first take away conveyor, or ii) onto one of the distribution conveyors and into collecting means positioned under other first take away conveyors using diverting means on the distribution conveyors.

In one preferred embodiment of the present invention the distribution conveyors comprise i) at least two conveyor belts running in opposite directions below the sorting unit and perpendicular to the position of the first take away conveyors, and ii) diverting means for diverting objects off the at least two conveyor belts into each of the collection means.

In one preferred embodiment of the present invention the first take away conveyors comprise two parallel conveyor belts.

In one preferred embodiment of the present invention the sorting unit comprises a chamber below the out feed end of each first take away conveyor, said chamber further comprising one or more diverting plates.

In one preferred embodiment of the present invention the collecting means comprises a conveyor for transporting the objects from the grading apparatus. The conveyor can be a cleated conveyor belt.

In one preferred embodiment of the present invention the grading unit comprises an in-feed device to regulate the velocity of the objects prior to delivery onto the ridge belts.

In one preferred embodiment of the present invention the two or more adjusting devices are operated by a motor, wherein the motor can be operated by the computing means.

In one preferred embodiment of the present invention the computing means sends feedback signals to a motor operating the adjusting device (7) to determine the distance between said ridge-belts during the grading process.conveyor belt.

In one preferred embodiment of the present invention the computing means sends signals to a motor operating the adjusting device (7) to determine the distance between said ridge-belts during the grading process. The distance between said ridge-belts can be altered while the belts are running due to the connection of the adjusting devices to the computing means.

In one preferred embodiment of the present invention the computing means sends signals to the in feeding mans to adjust the velocity of the objects entering the grading unit.

In one preferred embodiment of the present invention a control device attached to a adjusting screwing shaft of the adjusting device turns the adjusting screwing shaft to adjust the gap width.

In one preferred embodiment of the present invention the characteristic properties of objects determined by the imaging means and the computing means is selected from, but not limited to size, weight, species, and colour.

In an embodiment of the present invention the adjusting device is controlled by an industrial computer.

In an embodiment of the present invention the object graded by the method and the apparatus are food objects such as, but not limited to mackerel, horse mackerel, herring, blue whiting, silver smelt or shrimp.

In the present context the terms "adjusting device" or "adjusting unit" are used for the setting or adjusting device of the invention, which is placed under the guide rails and the running ridge belts of a grading machine to adjust or set the gap between the belts of the grading apparatus.

In one preferred embodiment of the present invention a control device or control mechanism is implemented on the adjusting device, coupled or attached to the adjusting screwing shaft, so that when the shaft is turned, the gap width is evenly adjusted. A control mechanism may comprise components such as, but not limited to; pressure means, f. ex. an electrical jack or a hydraulic jack; a motor, and a control board.

In one preferred objects of the present invention is solved by an apparatus for grading objects. The apparatus comprises a grading unit, two or more first take away conveyors, a sorting unit for each of the first take away conveyors, one or more distribution/correction conveyors, collecting means for each of the first take away conveyors, and computing means. The grading unit further comprises i) a plurality of endless ridge-belts arranged side by side and moved continuously in a forward direction, forming a gap there in-between, the gap being increased in the direction of movement, and ii) two or more adjusting devices arranged underneath said ridge-belts, said adjusting devices arranged for adjusting the distance between said ridge-belts along the length of the ridge-belts. The two or more first take away conveyors each comprise i) one or more parallel conveyor belts arranged perpendicular under the plurality of endless ridge-belts, and imaging means positioned above each first take away conveyor. Each collection means is positioned below it's corresponding first take away conveyor. The computing means is connected to each of the imaging means for processing said one or more images to determine at least one characteristic property of each object graded by the grading unit. The sorting unit is positioned below the out feed end of each of the first take away conveyors, but above the distribution conveyors. The sorting unit comprises diverting means for diverting objects dropped off the out feed end of the first take away conveyor onto one of the distribution conveyors or into the collecting means. Furthermore, the distribution conveyors comprise i) at least two conveyor belts running in opposite directions below the sorting unit and perpendicular to the position of the first take away conveyors, and ii) diverting means for diverting objects off the at least two conveyor belts into each of the collection means.

One object of the invention provides an apparatus for grading objects, where the apparatus comprises a grading unit, two or more first take away means positioned under the grading unit, collecting means for each of the first take away conveyors, imaging means for obtaining an image of one or more of the graded objects, and computing means. The grading unit comprises a plurality of endless ridge-belts arranged side by side and moved continuously in a forward direction, forming a gap there in-between, the gap being increased in the direction of movement, and two or more adjusting devices arranged underneath said ridge-belts, said adjusting devices arranged for adjusting the distance between said ridge-belts. The computing means is connected to each of the imaging means for processing said one or more images to determine at least one characteristic property of one or more of the graded objects. Furthermore, the computing means sends feedback signals to the adjusting device based on the image data to determine the distance between said ridge-belts during the grading process.

One object of the invention provides a method for grading objects. The method comprises a) grading objects in a grading unit comprising a plurality of endless ridge-belts arranged side by side and moved continuously in a forward direction, forming a gap there in-between, the gap being increased in the direction of movement, two adjacent belts receiving, conveying and releasing the products as the gap there between becomes greater than the product thickness onto the take away conveyors, b) adjusting the distance between said ridge-belts along the length of the ridge-belts using an adjusting device arranged underneath said ridge-belts, c) receiving objects from the grading unit on first take away conveyors arranged perpendicular under the plurality of endless ridge-belts, d) obtaining one or more images of graded objects, e) using the computing means for processing said one or more image to determine at least one characteristic property of each object. Furthermore, the computing means sends feedback signals to the adjusting device based on the image data to determine the distance between said ridge-belts during the grading process.

In one embodiment the first take away means comprises one or more parallel conveyor belts, screw conveyors or vibrating slide conveyors.

In one embodiment the first take away means can eject a sample from the take away means at certain intervals for obtaining an image of the sample.

In one embodiment the collecting means comprises i) a conveyor for transporting the objects from the grading apparatus or collection bins on a transport means, ii) collections bins, or iii) any collection means for collecting a batch after grading.

In one embodiment the two or more adjusting devices are operated by a motor.

In one embodiment the motor is operated by the computing means.

The gap size between the ridge belts is then set by using the control board, which can be a simple electrical control board attached to the grading device, having control buttons which rotate the adjusting screwing shaft in each direction as well as controlling the speed of the grading device and the in-feed device. The control board can further be a wireless remote control or an industrial computer, which co-ordinates the turning of the adjusting screwing shaft by the motor and the pressure applied by the pressure means.

An adjustment device as disclosed here is implemented on the in-feed end as well as on the outlet end of the grading device and as they are individually controlled, the gap width of each end can be altered without affecting the other.

In the present context the terms "distribution/correction conveyor" and "distribution conveyor" are used equally for the conveyors positioned perpendicular to the first takeaway conveyors with at least two conveyor belts running in opposite directions below the sorting unit.

DESCRIPTION OF DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PRESENT INVENTION

Figure 1:
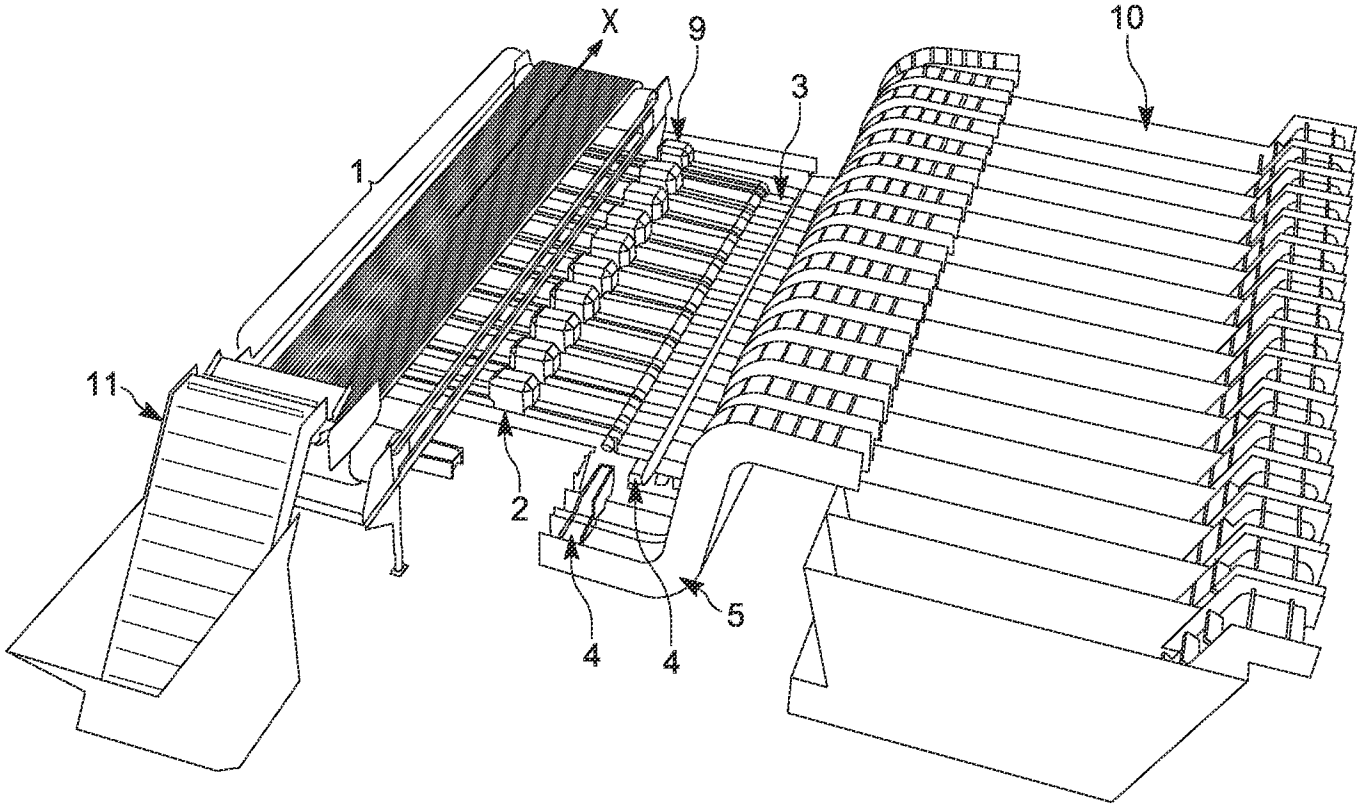
FIG. 1 is a perspective view of the device with an infeed hopper and grading bins.

FIG. 1 shows an overview of a grading apparatus according to the present invention. The apparatus has a grading unit 1 with a plurality of endless ridge-belts 6 arranged side by side and running continuously in a forward direction (x) forming a gap in-between the endless ridge-belts 6. The gap being increased in the direction of movement (x). The apparatus shown in FIG. 1 has ten first take away conveyors 2, each comprising two parallel conveyor belts 8 arranged perpendicular under the plurality of endless ridge-belts 6. Each first take away conveyor 2 has an imaging means 9 positioned above each take away conveyor. A sorting unit 3 is provided for each of the first take away conveyors 2, positioned below the out feed end of each of the first take away conveyors. The figure shows two distribution/correction conveyors 4 running in opposite directions below the sorting unit and positioned perpendicular to the position of the first take away conveyors. The collecting means 5 for each of the first take away conveyors 2 is shown as second take away conveyors with cleated and rising conveyor belts delivering graded objects into buffer chambers 10. The drawing also shows an infeed hopper 11 for feeding objects onto the grading unit.

Figure 2:
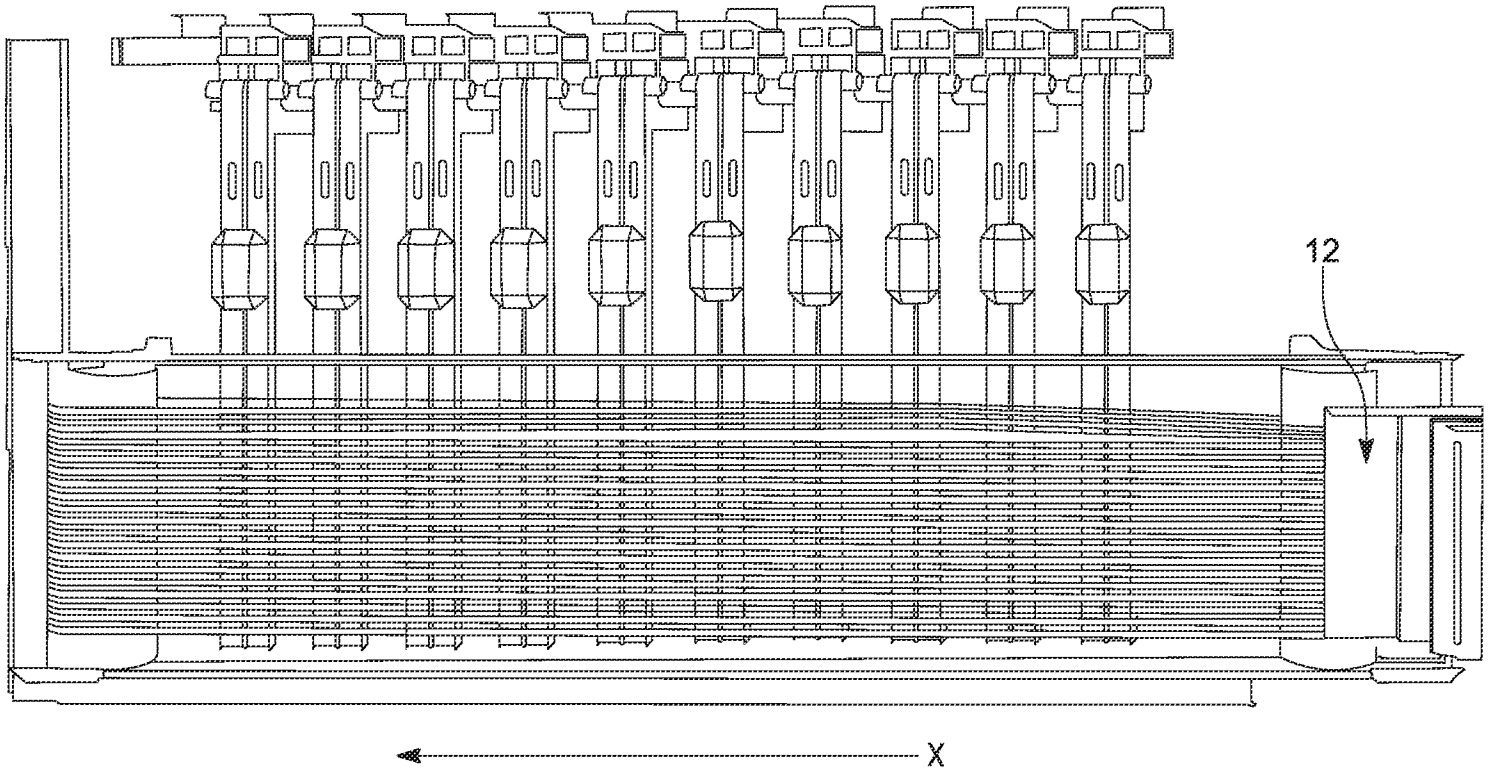
FIG. 2 is a top view of the device of the present invention.

FIG. 2 shows a grading unit 1 with ten take away conveyors 2. The top view shows how the distance between the ridge belts increases in the forward direction (x) away from the in-feeding device 12 to regulate the velocity of the objects prior to delivery onto the ridge belts.

Figure 3:
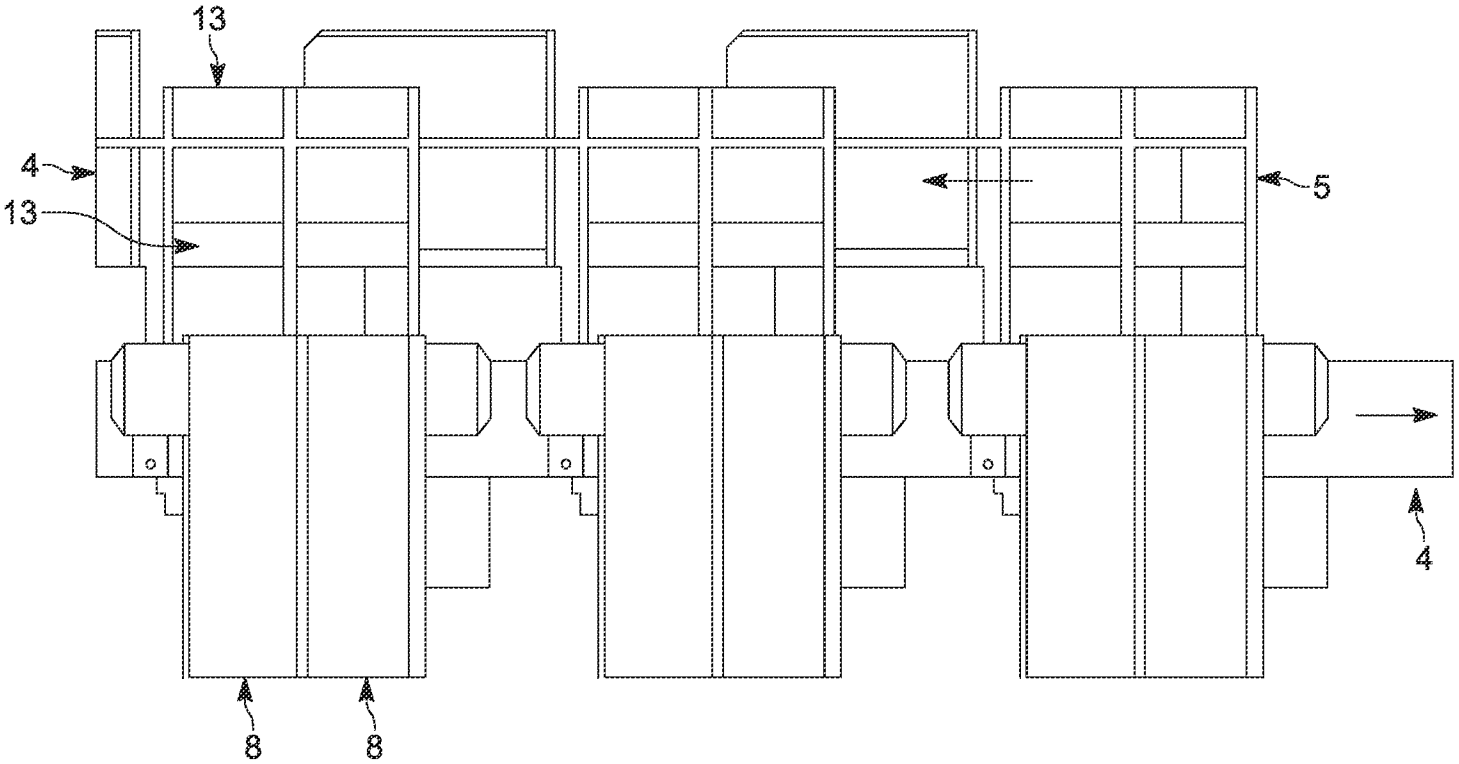
FIG. 3 is a top view of the sorting unit.

FIG. 3 shows an embodiment of the sorting unit 5 of the present invention. Three first take away conveyors are shown, where each first take away conveyor has two parallel conveyor belts 8 for a stream of graded objects. Each sorting unit has two set of diverting plates 13 for diverting the graded objects through the sorting unit straight into the collection means or onto distribution conveyors 4 running in opposite direction to deliver wrongly graded objects into other collection means using second diverting means 17.

Figure 4A:
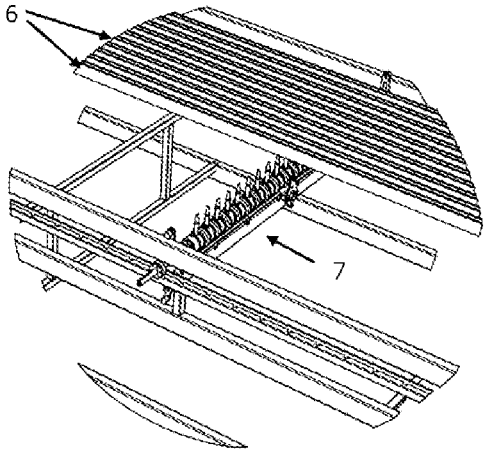
FIG. 4 shows the position of the adjusting device (A) and an enlargement thereof (B).
Figure 4B:
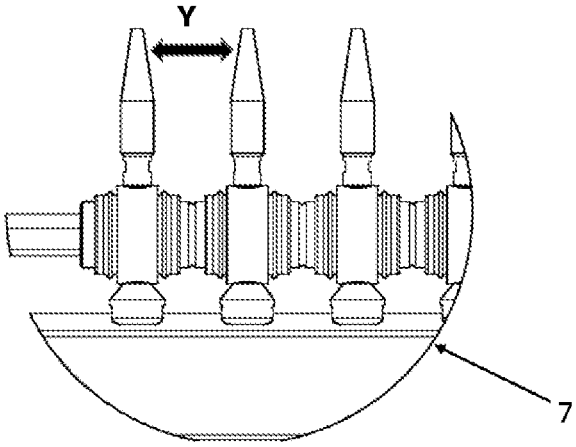

FIG. 4A shows one adjusting device 7 arranged under the ridge belts 6 and a motor 18 for operating the adjusting device 7. The enlarged portion (FIG. 4B) shows supporting pins of the adjusting device 7 supporting the guide rails. The distance (Y) between the pins is set by rotation of a setting bar penetrating the support pins.

Figure 5:
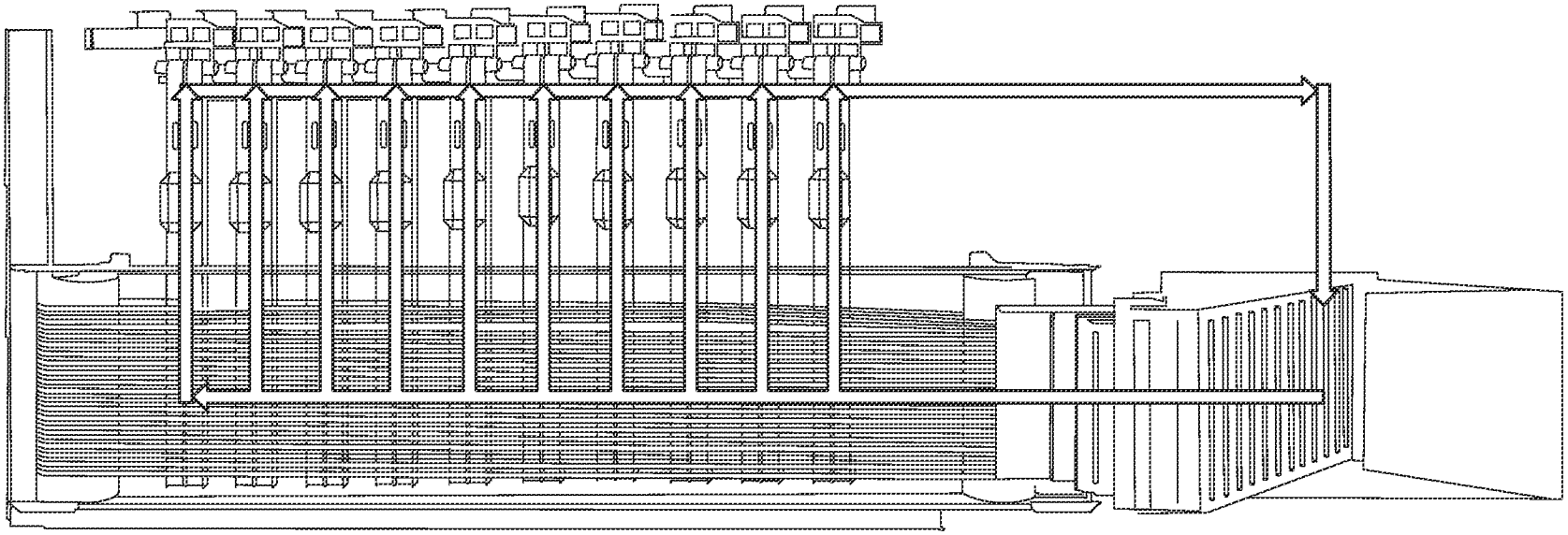
FIG. 5 outlines the calibration of the grading unit.
Figure 6A:
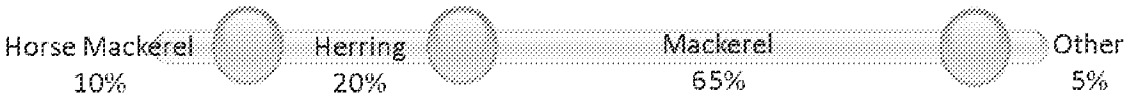
FIG. 6 is an example of grading of fish according to species and size/weight.
Figure 6B:
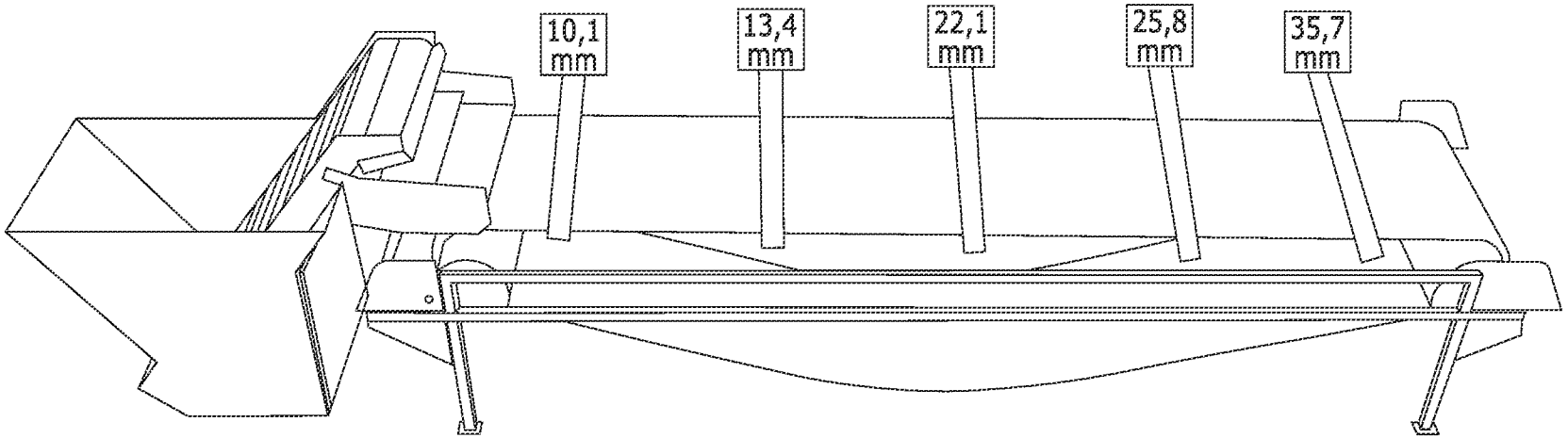
Figure 6C:
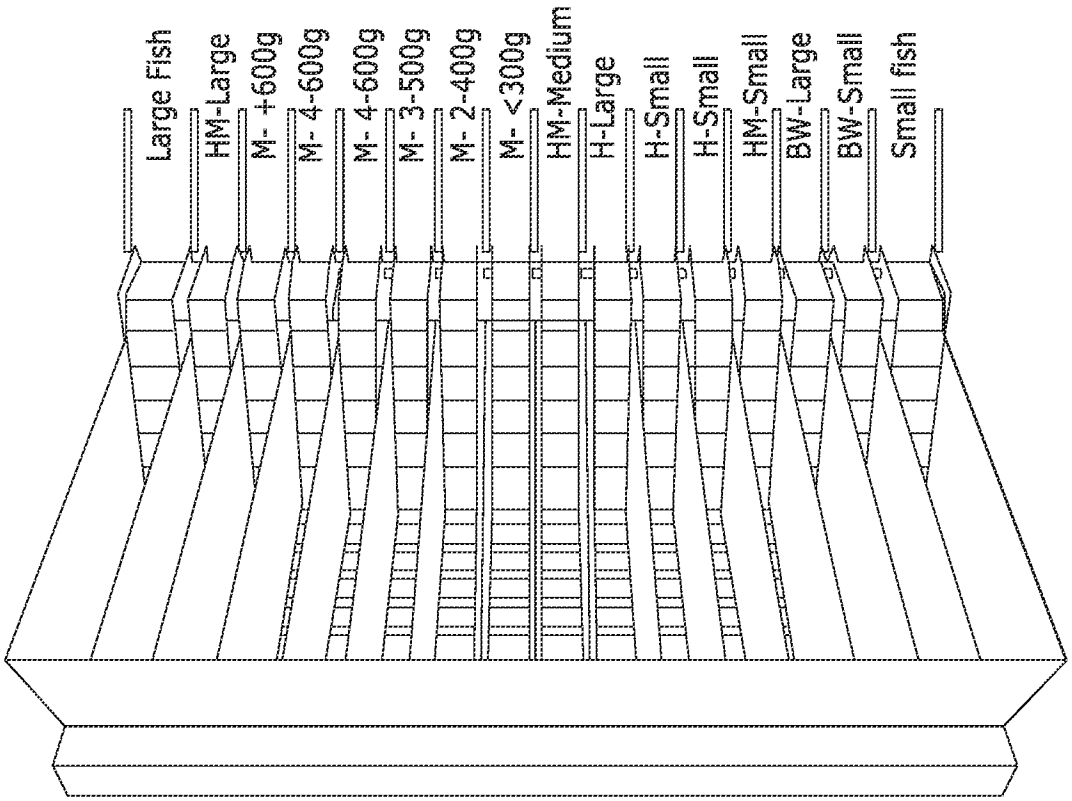
Figure 6D:
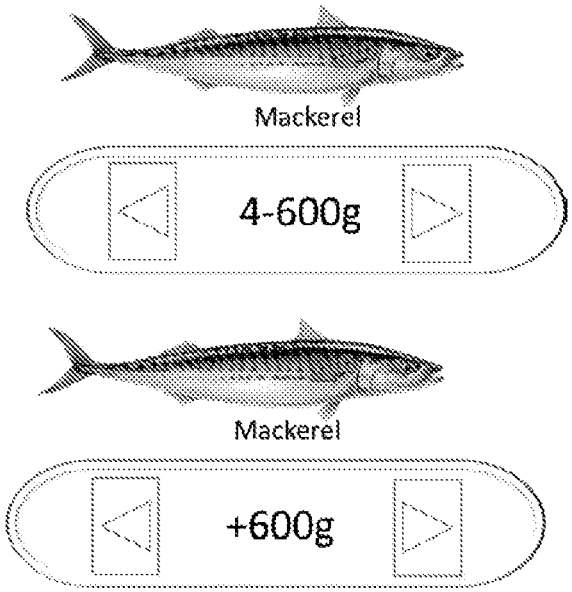

FIG. 5 shows the calibration of the grading apparatus of the present invention. In this embodiment objects are being collected by ten take away conveyors into as much as 10 categories. Calibrating the apparatus of the present invention can be done according the embodiment shown in in FIG. 4. A certain amount of objects are fed onto the grading unit and images of items received by the first take away conveyors are collected. The items are then transported back to the in feeding hopper and graded repeatedly on the grading unit. The computing means will obtain data on weight/size and species distribution within the objects to be graded. Based on this information the distance between the ridge belts can be set adjusted to determine the categories collected by each take away conveyor.

FIG. 6 shows an example of grading of five species of fish and the setting of the grading unit to perform grading of the five species using the apparatus of the present invention. In the example mackerel (M), horse mackerel (HM), herring (H), blue whiting (BW) and silver smelt are sorted and graded using the grading device of the invention. After calibration as shown in FIG. 5 a good estimation of species distribution is available and the setup of the device can be started. The percentage of each species can be set (FIG. 6A). FIG. 6B shows the grading unit indicating the distance between the ridge belts along the length of the grading unit set by the adjusting devices (not shown). In this example the infeed hopper and the grading unit are running at 1 m/s and the distance between the ridge belts starts at 10.1 mm and ends at 25.7 mm. In FIG. 6C a row of grading bins are shown and the designation of the graded fish. Large fish is graded into the bin on left, but large fish either falls between the ridge belts at the very end of the grading unit or off the end of the unit. Small fish including silver smelt falls into the first bin on the right. The other bins are arranged from smallest to largest including species differentiation based on the calibration in the beginning of the grading process. FIG. 6D shows how the settings can be altered to assign a category to a collection bin. If the great portion of the fish is of same species in a few weight categories it will affect the quality of the grading process and it will reduce the capacity of the apparatus to obtain images of all the fish. The settings of apparatus of the present invention can be changed during the grading process making it possible to collect the same category on a number of take away conveyors by altering the gap over an increased number of take away conveyors.

Figure 7:
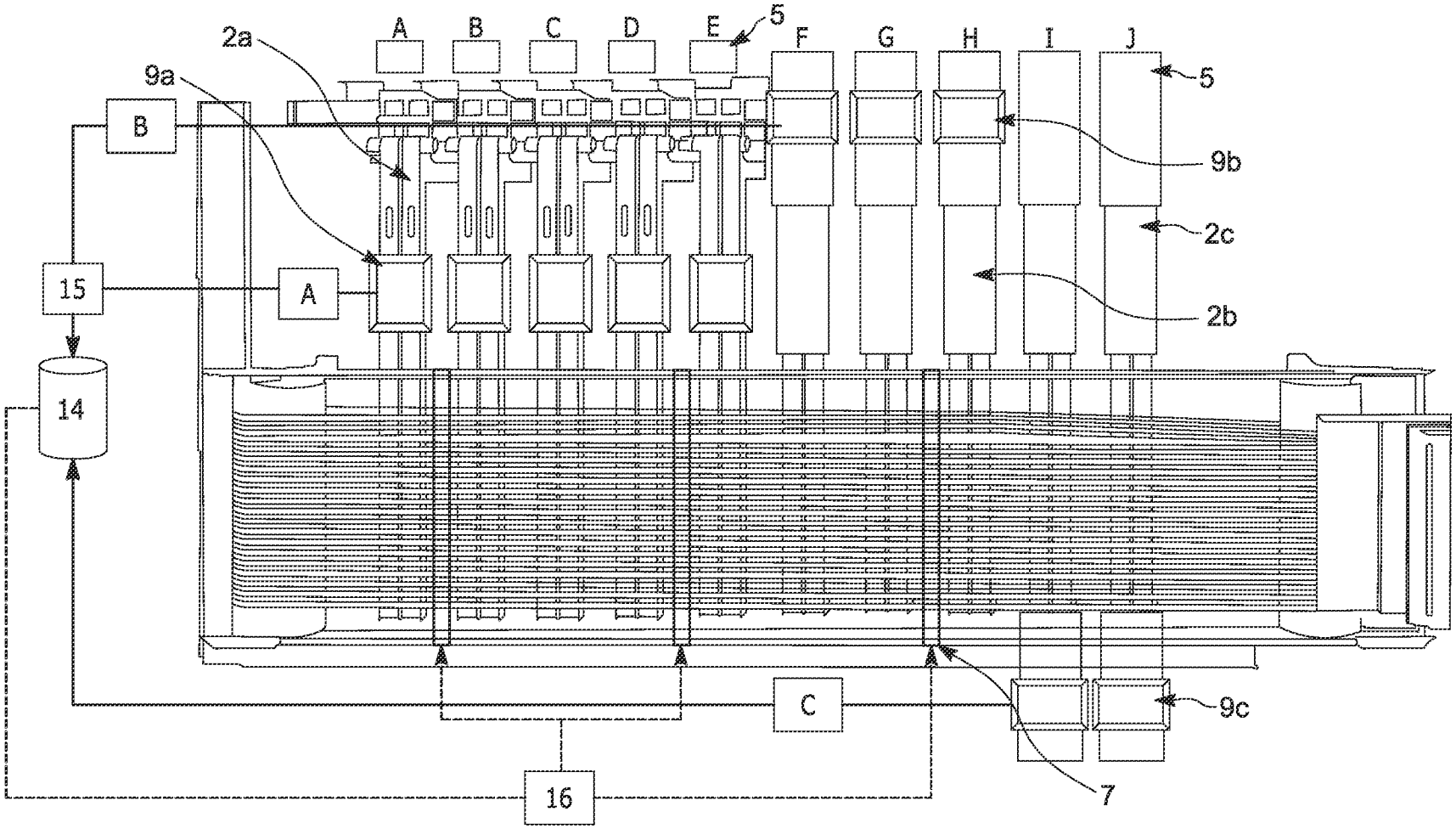
FIG. 7 outlines how feedback signals are used in several embodiments of the invention.

FIG. 7 shows how feedback signals are given from imaging devices to the adjusting means in three different embodiments of the inventions based on using different take away means. In the first embodiment (A) for take away means A-E a signal 15 is sent from imaging device 9*a* to the computing means 14 for processing. The computing means then sends a feedback signal 16 to the adjusting means 7 if the distance between the belts needs to be changed. In this embodiment the imaging means obtains an image of items being transported on a take away conveyor to be graded according to the embodiment disclosed in FIG. 3. In the second embodiment (B) for take away means F, G and H a signal 15 is sent from imaging device 9*b* to the computing means 14 for processing. The computing means then sends a feedback signal 16 to the adjusting means 7 if the distance between the belts needs to be changed. In this embodiment the conveyor transports the item to a collection means and an imaging device 9*b* obtains images being processed by the computing means to determine amount and/or size of items in the collection means. If the grading results is not acceptable or desired, feedback signals 16 are sent to the adjusting device to alter the distance between the belts for different grading. In the third embodiment (C) for take away means I and j a signal 15 is sent from imaging device 9*c* to the computing means 14 for processing. The computing means then sends a feedback signal 16 to the adjusting means 7 if the distance between the belts needs to be changed. In this embodiment the conveyor can run backwards for sending a sample of items in the opposite direction to leave the sample under an image means 9*c*. The imaging means obtains an image of the sample items and sends the signal to the computing means 14. Based on the image data from the sample, feedback signals 16 may be sent to the adjusting device to alter the distance between the belts for different grading.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. An apparatus for grading objects, comprising:

a grading unit, two or more first take away conveyors, a sorting unit for each of the first take away conveyors, one or more distribution/correction conveyors, collecting means for each of the first take away conveyors, and computing means, said grading unit comprising:

a plurality of endless ridge-belts arranged side by side and moved continuously in a forward direction, forming a gap there in-between, the gap being increased in the direction of movement, and two or more adjusting devices arranged underneath said ridge-belts, said adjusting devices arranged for adjusting the distance between said ridge-belts;

said two or more first take away conveyors each comprising:

one or more parallel conveyor belts arranged perpendicular under the plurality of endless ridge-belts, and imaging means positioned above each take away conveyor, wherein each collection means is positioned below its corresponding first take away conveyor, said computing means is connected to each of the imaging means for processing said one or more images to determine at least one characteristic property of each object, wherein said sorting unit being positioned below the out-feed end of each of the first take away conveyors, but above the distribution/correction conveyors, said sorting unit comprising first diverting means 13 for diverting objects dropped off the out-feed end of the first take away conveyor onto one of the distribution/correction conveyors or into the collecting means to deliver wrongly graded objects into other collection means; and the two or more adjusting devices are operated by a motor and wherein the motor is operated by the computing means.

2. An apparatus according to claim 1, said distribution/correction conveyors comprising:

at least two conveyor belts running in opposite directions below the sorting unit and perpendicular to the position of the first take away conveyors, and second diverting means for diverting objects off the at least two conveyor belts into each of the collection means.

3. An apparatus according to claim 1, wherein the first take away conveyors comprise two parallel conveyor belts.

4. An apparatus according to claim 1, wherein the sorting unit comprises a chamber below the out-feed end of each first take away conveyor, said chamber further comprising one or more diverting plates.

5. An apparatus according to claim 1, wherein the collecting means comprises a conveyor for transporting the objects from the grading apparatus.

6. An apparatus according to claim 5, wherein the conveyor is a cleated conveyor belt.

7. An apparatus according to claim 1, wherein the grading unit comprises an in-feed device to regulate the velocity of the objects prior to delivery onto the ridge belts.

8. An apparatus according to claim 1, wherein the computing means sends feedback signals to a motor operating the adjusting device to determine the distance between said ridge-belts during the grading process.

9. An apparatus according to claim 1, wherein the collecting means comprises a conveyor for transporting the objects from the grading apparatus or collection bins on a transport means.

10. A method for grading objects comprising:

grading objects in a grading unit comprising a plurality of endless ridge-belts arranged side by side and moved continuously in a forward direction, forming a gap there in-between, the gap being increased in the direction of movement, two adjacent belts receiving, conveying and releasing the products as the gap there between becomes greater than the product thickness onto the take away conveyors, adjusting the distance between said ridge-belts along the length of the ridge-belts using an adjusting device arranged underneath said ridge-belts, receiving objects from the grading unit on first take away conveyors arranged perpendicular under the plurality of endless ridge-belts, obtaining one or more images of all objects conveyed on each take away conveyor using imaging means, using computing means for processing said one or more image to determine at least one characteristic property of each object, and using a sorting unit positioned below the out-feed end of each first take away conveyor, but above the distribution/correction conveyors, for diverting objects dropped off the out-feed end of said first take away conveyor into either collection means positioned below the out-feed end of said first take away conveyor, or onto one of the distribution/correction conveyors and into collecting means positioned under other first take away conveyors using diverting means on the distribution/correction conveyors to deliver wrongly graded objects into other collection means, wherein the computing means sends signals to a motor operating the adjusting device to determine the distance between said ridge-belts during the grading process.

11. The method according to claim 10, wherein the computing means sends signals to the in feeding mans to adjust the velocity of the objects entering the grading unit.

12. A method according to claim 10, wherein a control device attached to an adjusting screwing shaft of the adjusting device turns the adjusting screwing shaft to adjust the gap width.

13. A method according to claim 10, wherein the characteristic properties of objects determined by the imaging means and the computing means is selected from, but not limited to size, weight, species, colour.

14. An apparatus for grading objects, comprising:

a grading unit, two or more first take-away means positioned under the grading unit, collecting means for each of the first take away conveyors, imaging means for obtaining an image of one or more of the graded objects, and computing means, said grading unit comprising:

a plurality of endless ridge-belts arranged side by side and moved continuously in a forward direction, forming a gap there in-between, the gap being increased in the direction of movement, and two or more adjusting devices arranged underneath said ridge-belts, said adjusting devices arranged for adjusting the distance between said ridge-belts;

said computing means is connected to each of the imaging means for processing said one or more images to determine at least one characteristic property of one or more of the graded objects, wherein the computing means sends feedback signals to the adjusting device based on the image data to determine the distance between said ridge-belts during the grading process.

15. An apparatus according to claim 14, wherein the first take away means comprises one or more parallel conveyor belts, screw conveyors or vibrating slide conveyors.

16. An apparatus according to claim 14, wherein the first take away means can eject a sample from the take-away means at certain intervals for obtaining an image of the sample.

17. An apparatus for grading objects, comprising:

a grading unit, two or more first take away means, collecting means for each of the first take away conveyors, and computing means, said grading unit comprising:

a plurality of endless ridge-belts arranged side by side and moved continuously in a forward direction, forming a gap there in-between, the gap being increased in the direction of movement, and two or more adjusting devices arranged underneath said ridge-belts, said adjusting devices arranged for adjusting the distance between said ridge-belts;

said two or more take away means each comprising:

means for taking a sample from the stream of objects being transported by said ridge-belts, and imaging means for obtaining an image of the sample of objects, wherein each collection means receives graded objects from at least one first take away means, said computing means is connected to each of the imaging means for processing said one or more images to determine at least one characteristic property of the sample of objects, wherein the computing means sends feedback signals to the adjusting device based on the image data to determine the distance between said ridge-belts during the grading process.

* * * * *